United States Patent [19]

Dufour, Sr.

[11] 4,389,920

[45] Jun. 28, 1983

[54] SEMIAUTOMATIC FIREARM

[76] Inventor: Joseph H. Dufour, Sr., 848 Castlewood Dr., Baton Rouge, La. 70815

[21] Appl. No.: 236,493

[22] Filed: Feb. 20, 1981

[51] Int. Cl.[3] ..... F41D 5/04

[52] U.S. Cl. ..... 89/190; 89/191 A

[58] Field of Search ..... 89/190, 191 A

[56] References Cited

U.S. PATENT DOCUMENTS

| | | | |
|---|---|---|---|
| 2,909,101 | 10/1959 | Hillberg | 89/191 A |
| 3,568,564 | 3/1971 | Badali | 89/191 A |
| 3,657,960 | 4/1972 | Badali | 89/191 A |
| 3,709,092 | 1/1973 | Tazome | 89/191 A |
| 3,869,961 | 3/1975 | Kawamura | 89/191 A |

OTHER PUBLICATIONS

Publication by Browning.
Pamphlet by Winchester.
Pamphlet by Remington Arms Company, Inc.
Pamphlet by Ithacagun of Ithaca, New York.

*Primary Examiner*—Stephen C. Bentley
*Attorney, Agent, or Firm*—Edgar E. Spielman; David L. Ray

[57] ABSTRACT

A gas operated system for use in semiautomatic firearms is disclosed. The gas operated system utilizes a gas powered assembly which is actuated by gas under pressure. The gas powered assembly is utilized to provide rearward motion to a drive assembly. The drive assembly has a rod associated therewith which engages unlocking structure so that this structure unlocks locking structure so that the bolt assembly can move rearwardly from the battery position. Movement of the bolt assembly rearwardly is accomplished principally due to expanding gas present in the barrel of the firearm which acts against the face of the bolt assembly.

29 Claims, 12 Drawing Figures

SEMIAUTOMATIC FIREARM

BACKGROUND OF THE INVENTION

Gas operated firearms have received wide acceptance in the marketplace. One of the main advantages of this type of firearm is that the shooter experiences less "kick" due to recoil than is the case for other types of firearm systems. This reduction in "kick" is partially due to the fact that the gas operated firearm utilizes a portion of the expanding gas released upon firing to reciprocally move the bolt assembly within the receiver, which movement automatically extracts and ejects the fired shell, recocks the trigger and delivers a new shell into the breach for reloading. Reduction in recoil or "kick" is also realized by venting excess gas, though initially routed to achieve the reciprocal movement, in a direction which minimizes its contribution to the recoil.

Almost universally the gas operated firearm relies upon a cylinder-piston arrangement to harness the energy of the expanding gas to accomplish the movement of the bolt assembly. In most instances the pressurized gas is routed to a cylinder which contains a piston which acts against or with a sleeve which is slidably mounted on the magazine portion of the firearm. The sleeve is often connected to the bolt assembly by at least one elongated slide arm. The slide arm is of substantial length since it is connected to the bolt assembly and must follow the bolt assembly throughout its entire movement. This substantial length is troublesome as the slide arms tend to bow when force is applied to them. To accommodate this bowing it is necessary to have relatively large apertures in the receiver through which the slides pass to make connection with the bolt assembly. The use of such large apertures is not desirable as the pressurized gas has a tendency to blow back into the receiver through these apertures. The result of this undesirable blow back is a deposit of carbon, powder fragments, etc. on the trigger group, reloading assembly, etc. which are located in the receiver.

One system which has been devised to allow the utilization of smaller apertures in the receiver through which the slide arm can operate is the one disclosed in U.S. Pat. No. 3,568,564 and U.S. Pat. No. 3,657,960. The system disclosed in these patents utilizes a relatively short push rod which is not connected to the bolt assembly. The push rod is positioned to contact an inertial piece and the bolt assembly during the work stroke. Since the push rod is not connected to the bolt assembly it can be designed relatively short thereby avoiding the bowing experienced by the longer slide arms during the work stroke. As there is little or no distortion of the push rod the apertures in the receiver through which it passes can be made for a fairly snug fit thereby reducing the amount of gas blown back into the receiver. Despite this advantage, this system has a significant drawback in that it relies upon the push rod providing the principal momentum to the bolt assembly to achieve its reciprocal movement within the receiver. In fact the thrust of the push rod against the bolt assembly and inertial piece must be of such magnitude that the sleeve, on to which the push rod is connected, is allowed to slide rearward until it impacts the front of the receiver. As can be appreciated, this impacting by the sleeve on the front of the receiver contributes to wear and tear, not to mention its contribution to "kick" felt by the shooter. Also the necessity of utilizing an inertial piece along with the bolt assembly contributes to complexity in manufacture and thus cost.

SUMMARY OF THE INVENTION

It is an object of this invention to provide a gas operated system for firearms which is very clean in operation and soft in "kick" or recoil.

It is a further object of this invention to provide a gas operated system in which the drive assembly, as hereinafter described, does not impact the receiver during its work stroke.

The above objects are accomplished by the gas operated assembly of this invention as it relies principally upon expanding gases in the barrel of the firearm, acting through the empty shell which has its end against the face of the bolt assembly, to be the main force which drives the bolt assembly rearwardly in the receiver to accomplish the extracting, ejecting, cocking and reloading functions. The gas operated system of this invention features a gas powered assembly which is in association with the barrel and the magazine. This assembly is activated by expanding gas routed thereto through a gas channel extending from the interior of the barrel to the gas powered assembly. The expanding gas will cause at least a part of the gas powered assembly to move towards the receiver. That part of the gas powered assembly which moves towards the receiver will act against a drive means to move it also towards the receiver. A rod is associated with the drive means and functions to act against an unlocking assembly used to unlock the bolt assembly from the battery position. The bolt assembly will then be free to move rearwardly in response to the expanding gas in the barrel. The unlocking assembly, if it is carried by the bolt assembly, need not be of great weight, as would be required if it were used as an inertial piece, as the main force acting to move the bolt assembly rearwardly in the receiver is provided by the expanding gas acting against the bolt assembly as before described.

THE INVENTION

The gas operated system of this invention is for use in semiautomatic firearms having a receiver, a barrel mounted to the receiver, a magazine positioned adjacent and parallel to the barrel, a bolt assembly recipocally mounted in the receiver and unlocking structure for unlocking structure found in the bolt assembly. The gas operated system of this invention can utilize any conventional gas powered assembly which is actuated by gas under pressure and which has at least a portion thereof which moves towards the receiver as a result of receipt of the gas. The source of the pressurized gas is preferably provided by a gas channel extending from the interior of the firearm barrel to the gas powered assembly. A drive assembly is also provided, which assembly is associated with the gas powered assembly so that it will move towards the receiver as urged by that portion of the gas powered assembly which moves toward the receiver. The drive assembly also has a rod associated therewith which will engage the unlocking structure to unlock the locking structure so that the bolt assembly can move rearwardly from the battery position. With the unique gas operated system of this invention it is only necessary that the rod make functional contact solely with the unlocking structure. This is in distinction to the system described in the before-cited U.S. patents which require the push rod to functionally contact the bolt assembly and an inertial piece. Since only the unlocking structure need be contacted by the rod the unlocking structure need not be associated with the bolt assembly. However, the unlocking structure can be associated with the bolt assembly as is the case for the Browning Automatic-5 shotgun made by Browning of Morgan, Utah. For this particular firearm the bolt assembly has a channel cut therein in which is slidably positioned an operating handle which, when pushed to the rear, acts to unlock the locking structure found in the bolt assembly.

Since the gas operated system of this invention does not have the rod connected to the bolt assembly a long work stroke is not required. The advantages of a short work stroke have been previously discussed. Even further, as the system of this invention need only provide the rod with sufficient energy to achieve the unlocking function, there is no need for a large thrust against the bolt assembly and thus no need for the drive assembly to impact the front of the receiver. In fact, the gas operated system of this invention utilizes a strong return means to keep this impact from occuring. Another function of the return means is conventional, that is, it returns the drive assembly with its rod to its original prior position which it had prior to firing of the firearm.

In preferred forms the gas operated system of this invention provides for a gas powered assembly which utilizes a cylinder attached to the barrel and surrounding a portion of the firearm magazine. The inside wall of the cylinder is spaced radially away from the outside wall of the magazine to provide an annular gas chamber. Fitted within the gas chamber is an annular piston which can achieve a gas seal with the inside cylinder wall and a gas-tight seal with the magazine. As can be appreciated, upon the application of the expanding gas to the piston it is pushed along the magazine towards the receiver to accomplish a work stroke when applied against the drive assembly. Other well known gas powered assemblies may also be used as long as at least a part of the assembly moves towards the receiver and contacts the drive assembly with sufficient force to accomplish the unlocking function. Exemplary of suitable assemblies are the ones used in the Browning Model 2000, the Remington Model 1100 and the Ithica Model 51, the assemblies being made respectively by Browning of Morgan, Utah, Remington Arms of Illion, N.Y. and Ithica Arms of Ithica, N.Y.

The drive assembly most preferably comprises a cylindrical sleeve which is slidably mounted on the magazine between the gas powered assembly and the front of the receiver. The rod, which is at the distal end of the drive assembly, need only have a length and configuration which will enable it to contact the unlocking structure for the purposes mentioned above. As will be seen, one system of this invention, which is particularly adapted for use with the Automatic-5 Shotgun produced by Browning, uses a rod which has upturned short leg connected to a longer horizontal leg. The distal end of the horizontal leg is dimensioned to fit within a groove in the receiver and to be in adjacent position with the operating handle. (Rearward movement of the operating handle on the Browning Automatic-5 acts to unlock the locking structure as hereinafter described.) Of course, other conventional drive systems may be utilized, the only requirement being that they be capable of rearward movement in response to action by the gas powered assembly and that they have a rod capable of achieving the unlocking function.

To achieve return of the drive assembly and rod to their original before firing position and to keep the drive assembly from impacting the front of the receiver the system of this invention utilizes a return assembly. The simplest and most effective return assembly is a coil spring mounted around the magazine between the drive assembly and the receiver. In this preferred system the spring need only be of sufficient strength to prevent the drive assembly from impacting the front of the receiver and to return the drive assembly to its original prior position. The spring in this mode achieves its function due to its compression. Other return assemblies can be used with the system of this invention as long as they accomplish these functions.

These and other features contributing satisfaction in use and economy in manufacture will be more fully understood from the following description of a preferred embodiment of the invention when taken in connection with the accompanying drawings in which identical numerals refer to identical parts and in which.

Figure 1:
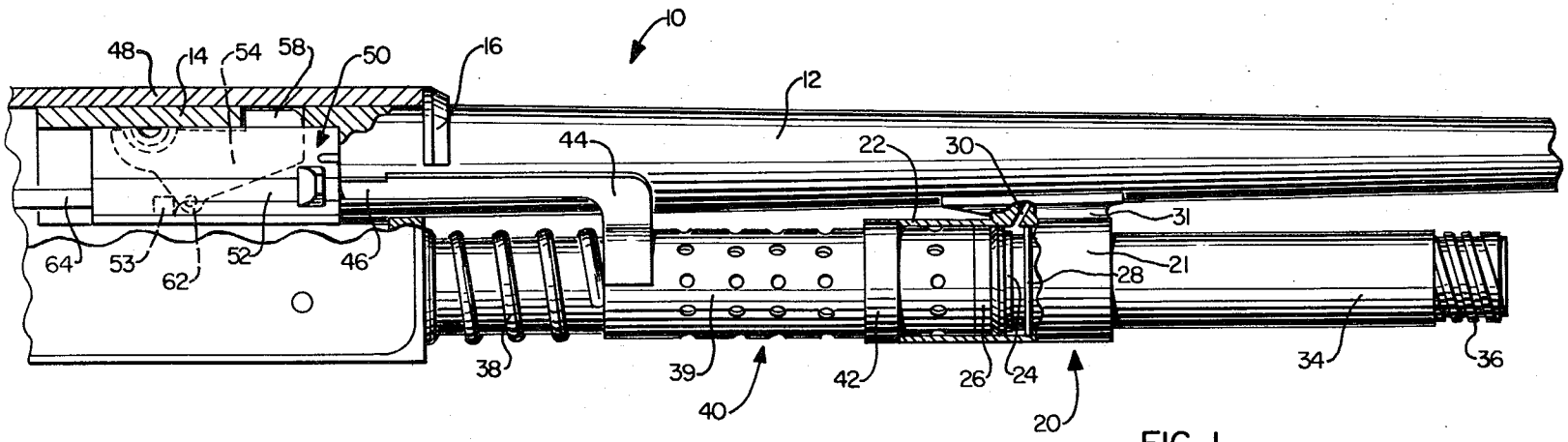
FIG. 1 is a partial view of a semiautomatic firearm utilizing a gas operated system of this invention with the system in the before firing mode.

Referring now to FIGS. 1–10, there can be seen a firearm, generally designated by the numeral 10, having a barrel 12, receiver 48 and magazine 34. Magazine 34, for the embodiment shown, is permanently attached to the front of receiver 48. Barrel 12 is slidably received in receiver 48. Within receiver 48 is barrel extension 14. For the embodiment shown in the drawings, a gas powered assembly, generally designated by the numeral 20, is affixed to the underside of barrel 12. Magazine collar 21 is attached to gas powered assembly 20 and has an inside diameter such that it fits snugly and slidably around magazine 34. Note that this slidable fit allows for easy removal of barrel 12 from magazine 34 by sliding barrel 12 from magazine 34. To keep barrel 12 from extending any further into receiver 48 there is provided stop 16 which is rigidly affixed to barrel 12.

Figure 7:
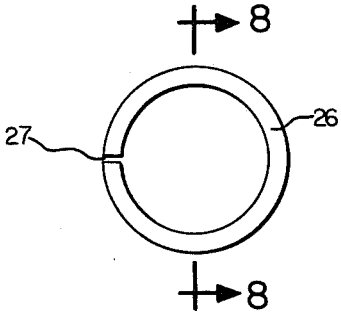
FIG. 7 is a front elevational view of the annular piston portion of a gas powered system of this invention.
Figure 8:
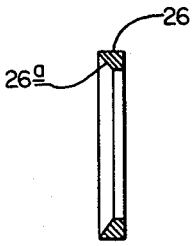
FIG. 8 is a sectional view taken through section lines 8—8 in FIG. 7.
Figure 9:
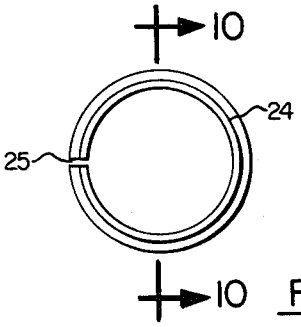
FIG. 9 is a sectional view of a piston seal used with the piston shown in FIG. 7.
Figure 10:
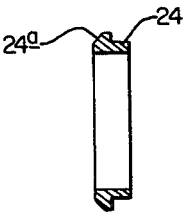
FIG. 10 is a sectional view taken through section lines 10—10 in FIG. 9.

Gas powered assembly 20 has a cylinder portion 22 having an inside wall diameter greater than the outside wall diameter of magazine 34. This radial displacement of the inside wall of cylinder 22 from the outside wall of magazine 34 is affected so as to provide an annular gas chamber. Fitting within the gas chamber is a piston assembly which is made up of annular piston 26 and piston seal 24. In FIGS. 7 and 8 piston 26 is shown to be a split ring piston having a gap 27. In FIG. 8 it is seen that piston 26 has an inwardly beveled face 26*a*. In FIGS. 9 and 10 piston seal 24 is a split ring seal having a gap 25. Piston seal 24 has an upwardly standing bevel face 24*a* which is dimensioned to nest against bevel face 26*a* of piston 26. In operation, when pressurized gas enters into the gas chamber its action upon piston seal 24 which causes it to close around magazine 34 thereby providing a seal around magazine 34. Since bevel face 24*a* is nested against bevel face 26*a* forward motion of piston seal 24 will cause piston 26 to expand outwardly against the inside wall of cylinder 22. Entry into cylinder 22 of pressurized gas is provided by gas channel 30. Note that gas channel 30 is positioned ahead of piston 26 and piston seal 24 but aft of forward seal 28 which is, most preferably, a rubber O-ring. Forward seal 28 prevents gas leakage out of the gas chamber formed between magazine 38 and cylinder 22. Gas channel 30 communicates to the interior of barrel 12.

Between receiver 48 and piston 26 there is provided a drive assembly, generally designated by the numeral 40. Note that drive assembly 40 has a cylindrical cylinder 39 which is slidably mounted onto magazine 34. The proximate end of cylindrical cylinder 39 is adjacent piston 26. Dimensioned away from the proximate end of cylindrical cylinder 39 is stop ring 42 which is affixed thereto. The position of stop ring 42 from the proximate end of cylindrical cylinder 39 is such that cylindrical cylinder 39 will not push piston 26 or piston seal 24 forward of gas channel 30. Cylindrical cylinder 39 has numerous apertures 41 therethrough. By having apertures 41 cylindrical cylinder 39 can be made of any heavy duty metal with all the advantages of strength attributable thereto without an undue weight penalty. Also apertures 41 aid in cleaning of magazine 34. At the distal end of cylindrical cylinder 39 is rod portion 44 which has an end of reduced size which is labeled 46. By having end 46 of reduced size it is capable of fitting into a groove in receiver 48 so that it may be in proper position as hereinafter described. Keeping the remainder of the horizontal portion of rod 44 a larger size is advantageous in that it aids in rigidifying rod 44.

The return assembly utilized in the embodiment shown in the drawings is helical spring 38 which fits between drive assembly 40 and receiver 48. Helical spring 38 should be of sufficient strength to keep drive assembly 40 from impacting the front of receiver 48 and have sufficient strength to return assembly 40 to the position shown in FIG. 1.

Figure 11:
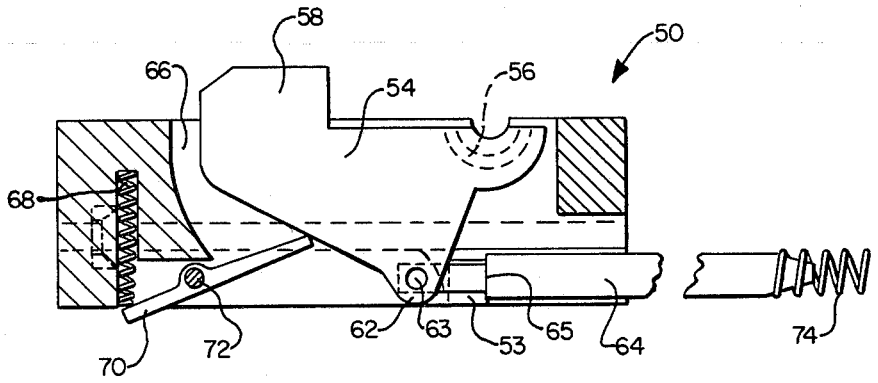
FIG. 11 is a sectional partial view of a bolt assembly with the locking structure in the locked position.
Figure 11A:
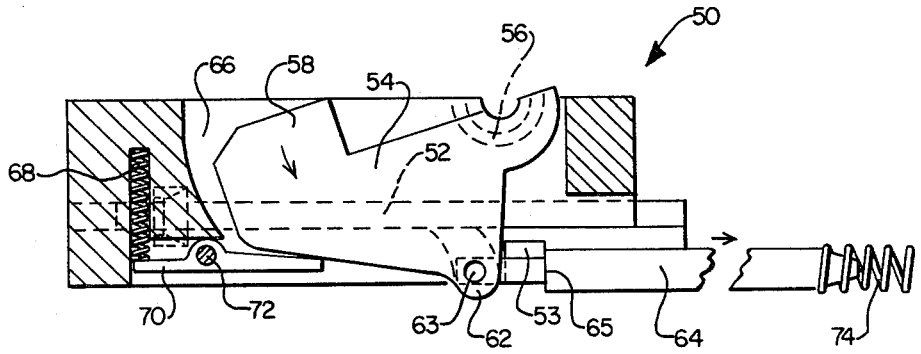
FIG. 11A is a view of the bolt assembly shown in FIG. 11 with the locking structure in the unlocked position.

Within receiver 48 there is a bolt assembly, generally designated by the numeral 50. Bolt assembly 50 contains a firing pin (not shown), extractors, locking block 54, and locking block latch 70 which latter is shown in FIGS. 11 and 11A. Operating handle 52 slidably fits within a groove cut into bolt assembly 50. Operating handle 52 has an inwardly directed boss 53. As can be seen in FIGS. 1, 2, 11 and 11A, locking block 54 has an upstanding locking boss 58. Locking boss 58 fits within locking recess 18, shown in FIG. 2, which is cut into barrel extension 14. It is to be understood that other structure may be utilized to provide interference with locking boss 58. For example, instead of having barrel extension 14 there can be provided a downwardly extending boss from the top inside surface of receiver 48 which would be in interferring fit with locking boss 58. Locking block 54 is pivotally mounted about pivot point 56 within bolt assembly 50. At its lower end locking block 54 has a yoke 62 which is provided for connection with link 64, shown in FIGS. 11 and 11A, by way of pin 63. Link 64 has a shoulder 65 which has an interferring position with inwardly extending boss 53 on operating handle 52. As can be seen in FIGS. 11 and 11A, inwardly extending boss 53 abuts against yoke 62 on one of its sides and against shoulder 65 on its other side. Urging link 64 forwardly is spring 74 which is received rearwardly of receiver 48. Since shoulder 65 is in abutting fit with inwardly directed boss 53, it can be appreciated, as is shown in FIG. 11, that operating handle 52 is urged in the forward position by pressure from spring 74. Also, since inwardly directed boss 53 abuts against yoke 62 spring 74 will urge locking block 54 in the position shown in FIG. 11. To further maintain locking block 54 in the locked position, as shown in FIG. 11, there is provided locking block latch 70. Locking block latch 70 is pivotally mounted by way of pin 72 and has an arm biased upwardly by effect of spring 68 which is nested in a spring recess in bolt assembly 50.

Figure 2:
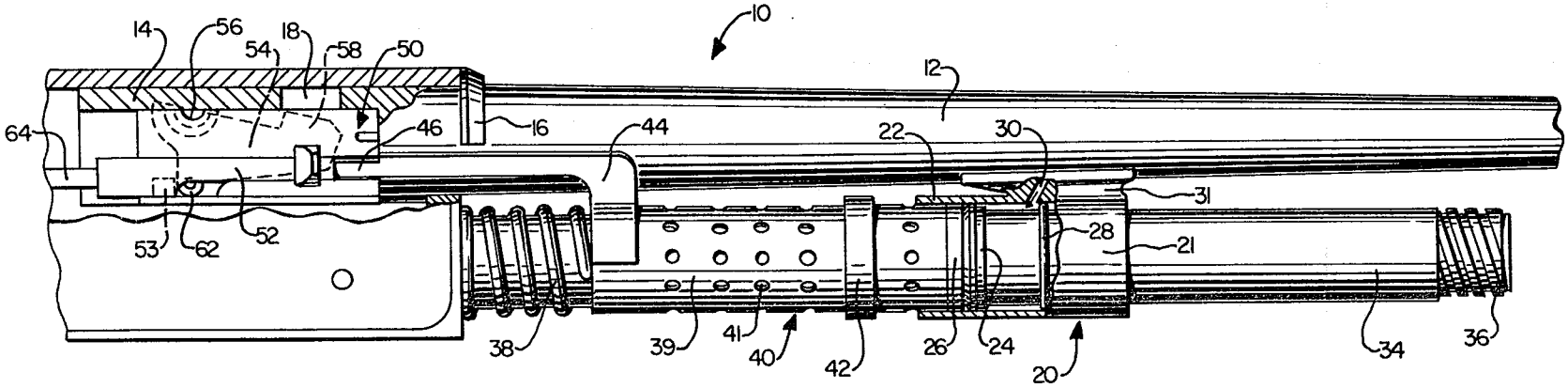
FIG. 2 is a partial view of the firearm shown in FIG. 1 with the gas operated system in the power stroke mode.
Figure 3:
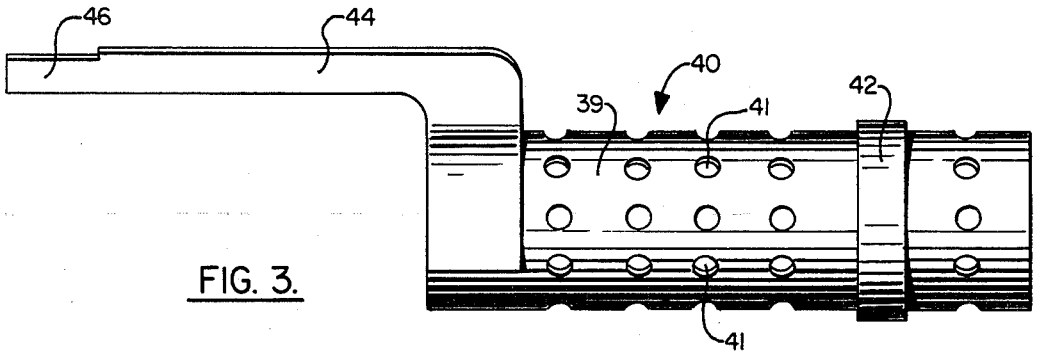
FIG. 3 is a side elevational view of a preferred drive assembly of this invention.
Figure 4:
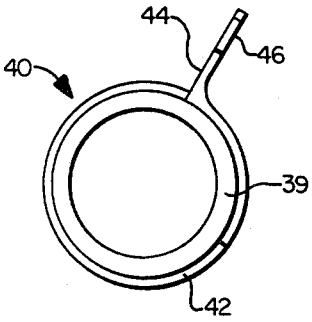
FIG. 4 is a front elevational view of the assembly shown in FIG. 3.
Figure 5:
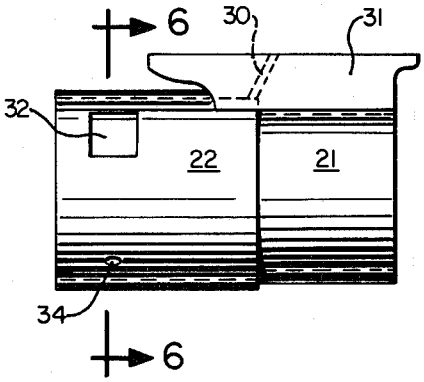
FIG. 5 is a side elevational view of the cylinder portion of a gas powered assembly of this invention.
Figure 6:
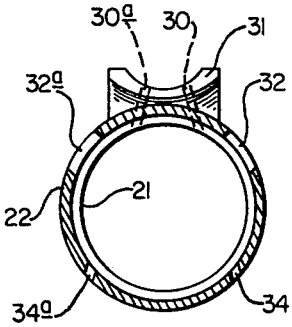
FIG. 6 is a sectional view taken through section lines 6—6 of FIG. 5.

In operation the gas operated system of this invention is the paragon of simplicity while at the same time providing soft recoil and low wear and tear on component parts. FIGS. 1 and 11 show the position of the essential parts of the gas operated system of this invention as it would be when bolt assembly 50 is in the battery position. Note that locking boss 58 is nested in locking recess 18 and locking block latch 70 is urging locking block boss 58 in this upward position. Also operating handle 52 is fully forward with inwardly directed boss 53 being urged by spring 74 against yoke 62. Upon firing of semiautomatic firearm 10 the rapidly burning powder provides gas under high pressure to propel the shot forward. A portion of this highly pressurized gas is routed to the annular gas chamber by way of gas channel 30. As can be seen in FIG. 6 for the embodiment shown in the drawings, there can be provided two gas channels 30 and 30*a*. It is to be understood that only one gas channel may be utilized or that more than two may be utilized depending upon the size of the channel and the amount of gas needed to operate the gas powered assembly. Once the expanding gas enters the gas chamber it pushes against piston 26 and piston seal 24 so that they may achieve their beforedescribed sealing requirements with the cylinder inside wall and the magazine outside wall respectively. Piston 26 is in abutment with cylindrical cylinder 39 and pushes it forward as it is pushed forward by the gas. Spring 38 begins compression while rod 44 begins its rearward movement which brings the rod into contact with operating handle 52. The distance traveled by operating handle 52 is short as it only need to be a distance to achieve the unlocking function. This position is shown in FIG. 2. Piston 26 and piston seal 24 move until they intersect exhaust ports 32 and 32*a* which are shown in FIGS. 5 and 6. At this point the gas will exhaust through ports 32 and 32*a* thus relieving a great majority, if not all, of the pressure on piston 26 and piston seal 24. At this point rod 44 has pushed operating handle 52 rearwardly against the bias of spring 74. As can be seen in FIG. 11A, this rearward movement results in link 64 being moved rearwardly also. The position of yoke 62 also changes since it is affixed to link 64. Change in the position of yoke 62 results in locking block 54 pivoting about pivot point 56 thereby lowering locking boss 58 which removes it from locking relationship with locking recess 18. See FIG. 2. In FIG. 11A locking block latch 70 is moved downwardly against spring tension 68. At this point bolt assembly 50 is unlocked and free to move rearwardly to accomplish extracting, ejecting, cocking, loading functions which are conventional in semiautomatic firearms. The main impetus for bolt assembly 50 to move rearwardly to accomplish these functions is provided by the still expanding gas which is still within barrel 12. This gas will act against the shell which is in communication with the face of bolt assembly 50. It is important to note that operating handle 52 may be of a weight considerably less than the whole weight of bolt assembly 50 since there is little, if any, reliance upon any momentum which operating handle 52 may impart to bolt assembly 50 to move bolt assembly 50 rearwardly.

After rod 44 has accomplished its unlocking function, spring 38 returns drive assembly 40 along with rod 44 to the position shown in FIG. 1. Since the proximate end of cylindrical sleeve 39 is in abutment with piston 26 and piston seal 24 they also will be returned to the position shown in FIG. 1. They also will move easily along magazine 24 as both piston 26 and piston seal 24 are in the relaxed mode, i.e., piston 26 is no longer expanded and piston seal 24 is no longer retracted.

By having rod 46 completely back in the position shown in FIG. 1, the ejection port which is generally located on the right hand side of the receiver, will be completely free so that the spent shell can be ejected.

Though it is not shown in the drawings, it is to be understood that a fore-end hand piece is provided to enclose magazine 34 along with gas powered assembly 20 and drive assembly 40. Such a fore-end hand piece also will insure that barrel 12 remains in proper position within receiver 48. Threaded end 36 of magazine 34 is for receipt of a magazine cap which will secure the fore-end hand piece in its proper position. The gas which escapes through ports 32 and 32*a* will escape into the fore-end hand piece and be diverted upwardly out of harm's way and with minimum effect on recoil.

As an added feature, the gas operated system of this invention can be provided with clean out ports which are labeled 34 and 34*a* in FIGS. 5 and 6. These ports are in line with gas channels 30 and 30*a* so that cleaning apparatus can be passed through ports 34 and 34*a* into gas channels 30 and 30*a* to effect cleaning.

What is claimed is:

1. In a semiautomatic firearm having (i) a receiver, (ii) a barrel mounted to said receiver, (iii) a magazine positioned adjacent to said barrel, (iv) a bolt assembly reciprocally mounted in said receiver, said bolt assembly having locking structure for locking said bolt assembly in the battery position, and unlocking structure for unlocking the lock achieved by said locking structure, the improvement which features a gas operated system which comprises:

a. gas powered means in association with said barrel and said magazine, said gas powered means being actuated by expanding gas to provide powered movement by at least a portion of said gas powered means towards said receiver;

b. at least one gas channel extending from the interior of said barrel to said gas powered means to communicate said expanding gas to said gas powered means when said firearm is fired;

c. drive means having its proximate end in association with said gas powered means whereby said powered movement by said at least portion of said gas powered means imparts movement to said drive means towards the receiver, said drive means having at its distal end a rod means adjacent but not connected to said unlocking structure, whereby said movement of said drive means operatingly engages said rod means with only said unlocking structure to unlock said lock structure so that said bolt assembly is free to move away from said battery position; and d. return means in contact with said drive means for preventing impacting of said drive means with said receiver and for returning said drive means and said rod means to their original prior position so that said bolt assembly is free to return to the battery position and said locking structure can reattain its locking of said bolt assembly.

2. The gas operated system of claim 1 wherein said at least portion of said gas powered means is a first annular piston means and wherein said gas powered means comprises:

a. a cylinder attached to said barrel and surrounding a portion of said magazine, the inside wall of said cylinder being radially spaced away from the outside wall of said magazine to provide an annular gas chamber; and b. said annular piston means which is slidably mounted on said magazine within said gas chamber, said first annular piston being capable of achieving a gas sealing contact with said inside wall of said cylinder and the outside wall of said magazine.

3. The gas operated system of claim 1 wherein said gas channel is linear.

4. The gas operated system of claim 1 wherein said drive means is a cylindrical sleeve slidably mounted on said magazine.

5. The gas operated system of claim 1 wherein said rod means has a portion which fits interiorally of said receiver.

6. The gas operated system of claim 1 wherein said rod means is integral with said drive means.

7. The gas operated system of claim 4 wherein said rod means is integral with said drive means.

8. The gas operated system of claim 2 wherein said drive means is a cylindrical sleeve slidably mounted on said magazine, said rod means is integral with said drive means and wherein the proximate end of said cylindrical sleeve is drivingly engaged with said first annular piston means.

9. The gas operated system of claim 5 wherein said rod means is integral with said drive means.

10. The gas operated system of claim 9 wherein said drive means is a cylindrical sleeve slidably mounted on said magazine.

11. The gas operated system of claim 10 wherein said at least portion of said gas powered means is a first annular piston means and wherein said gas powered means comprises:

a. a cylinder attached to said barrel and surrounding a portion of said magazine, the inside wall of said cylinder being radially spaced away from the outside wall of said magazine to provide an annular gas chamber; and b. said annular piston means which is slidably mounted on said magazine within said gas chamber said annular piston being capable of achieving a gas sealing contact with said inside wall of said cylinder and the outside wall of said magazine.

12. The gas operated system of claim 5 wherein said drive means is a cylindrical sleeve slidably mounted on said magazine.

13. The gas operated system of claim 12 wherein said at least portion of said gas powered means is a first annular piston means and wherein said gas powered means comprises:

a. a cylinder attached to said barrel and surrounding a portion of said magazine, the inside wall of said cylinder being faced away from the outside wall of said magazine to provide an annular gas chamber; and b. said first annular piston means which is slidably mounted on said magazine within said gas chamber, said first annular piston being capable of achieving a gas sealing contact with said inside wall of said cylinder and the outside wall of said magazine.

14. The gas operated system of claim 1 wherein the return means is mounted on said magazine between said drive means and said receiver.

15. The gas operated system of claim 14 wherein said return means is a spring.

16. In a semiautomatic firearm having (i) a receiver, (ii) a barrel mounted to said receiver, (iii) a magazine positioned adjacent and parallel to said barrel, (iv) a bolt assembly reciprocally mounted in said receiver, said bolt assembly having a hollow chamber into which pivotally nests a locking block having an upstanding locking boss forward of its pivot point and connecting structure located below its pivot point for connection to a link which is forwardly spring biased and said bolt assembly additionally having a locking block latch to urge said locking block to maintain a locking relationship with other cooperating locking structure within said receiver, and having an operating handle slidably carried in a groove in said bolt assembly, said operating handle having adjacent its rearward end a boss which in in abutment on its forward face with said connecting structure and on its rearward face with a shoulder on said link, the improvement which features a gas operated system which comprises:

a. gas powered means in association with said barrel and said magazine, said gas powered means being actuated by expanding gas to provide powered movement by at least a portion of said gas powered means towards said receiver;

b. at least one gas channel extending from the interior of said barrel to said gas powered means to communicate said expanding gas to said powered means when said firearm is fired;

c. drive means having its proximate end in association with said gas powered means whereby said powered movement by said at least portion of said gas powered means imparts to said drive means movement towards said receiver, said drive means having at its distal end a rod means adjacent but not connected to the forward end of said operating handle whereby said movement of said drive means engages said rod means only with said operating handle to push said operating handle rearwardly thereby moving said link rearwardly against its forwardly spring bias, said movement of said link causing said locking block to rotate downwardly about its pivot point and against said urging of said locking block latch whereby said locking boss moves from locking cooperation with said cooperating locking structure; and d. return means in contact with said drive means for preventing impacting of said drive means with said receiver and for returning said drive means and said rod means to their original prior position so that said bolt assembly is free to return to the battery position and said locking block can re-attain its locking cooperation with said other locking structure within said receiver.

17. The gas operated system of claim 16 wherein said at least portion of said gas powered means is a first annular piston means and wherein said gas powered means comprises:

a. a cylinder attached to said barrel and surrounding a portion of said magazine, the inside wall of said cylinder being radially spaced away from the outside wall of said magazine to provide an annular gas chamber; and b. said annular piston means which is slidably mounted on said magazine within said gas chamber, said first annular piston being capable of achieving a gas sealing contact with said inside wall of said cylinder and the outside wall of said magazine.

18. The gas operated system of claim 16 wherein said drive means is a cylindrical sleeve slidably mounted on said magazine.

19. The gas operated system of claim 16 wherein said rod means has a portion which fits interiorally of said receiver.

20. The gas operated system of claim 16 wherein said rod means is integral with said drive means.

21. The gas operated system of claim 18 wherein said rod means is integral with said drive means.

22. The gas operated system of claim 17 wherein said drive means is a cylindrical sleeve slidably mounted on said magazine, said rod means is integral with said drive means and wherein the proximate end of said cylindrical sleeve is drivingly engaged with said annular piston means.

23. The gas operated system of claim 19 wherein said rod means is integral with the drive means.

24. The gas operated system of claim 23 wherein said drive means is a cylindrical sleeve slidably mounted on said magazine.

25. The gas operated system of claim 24 wherein said at least portion of said gas powered means is a first annular piston means and wherein said gas powered means comprises:

a. a cylinder attached to said barrel and surrounding a portion of said magazine, the inside wall of said cylinder being radially spaced away from the outside wall of said magazine to provide an annular gas chamber; and b. said annular piston means which is slidably mounted on said magazine within said gas chamber, said first annular piston being capable of achieving a gas sealing contact with said inside wall of said cylinder and the outside wall of said magazine.

26. The gas operated system of claim 19 wherein said drive means is a cylindrical sleeve slidably mounted on said magazine.

27. The gas operated system of claim 25 wherein said at least portion of said gas powered means is a first annular piston means and wherein said gas powered means comprises:

a. a cylinder attached to said barrel and surrounding a portion of said magazine, the inside wall of said cylinder being radially spaced away from the outside wall of said magazine to provide an annular gas chamber; and b. said annular piston means which is slidably mounted on said magazine within said gas chamber, said first annular piston being capable of achieving a gas sealing contact with said inside wall of said cylinder and the outside wall of said magazine.

28. The gas operated system of claim 16 wherein said return means is mounted on said magazine between said drive means and said receiver.

29. The gas operated system of claim 28 wherein said return means is a spring.

* * * * *